United States Patent [19]

Czechowski

[11] Patent Number: 4,955,173

[45] Date of Patent: Sep. 11, 1990

[54] STRUCTURAL STEEL CORROSION PROTECTION BY INERT GAS

[76] Inventor: John K. Czechowski, 18111 Jolly St., Apt. 106, Huntington Beach, Calif. 92648

[21] Appl. No.: 410,304

[22] Filed: Sep. 21, 1989

[51] Int. Cl.[5] ..... E04C 1/40; E04C 2/34

[52] U.S. Cl. ..... 52/727; 52/791

[58] Field of Search ..... 52/724, 725, 727, 728, 52/791

[56] References Cited

U.S. PATENT DOCUMENTS

| | | | |
|---|---|---|---|
| 1,104,346 | 7/1914 | Church | 52/727 X |
| 1,813,873 | 7/1931 | Brogden | 52/727 X |
| 3,939,665 | 2/1976 | Gosse | 52/728 X |
| 4,019,301 | 4/1977 | Fox | 52/727 X |
| 4,081,941 | 4/1978 | Van Ausdall | 52/728 X |
| 4,244,156 | 1/1981 | Watts | 52/728 X |
| 4,347,019 | 8/1982 | Metz | 52/727 X |

FOREIGN PATENT DOCUMENTS

| | | | |
|---|---|---|---|
| 782120 | 9/1957 | United Kingdom | 52/724 |
| 983409 | 2/1965 | United Kingdom | 52/727 |
| 1201820 | 8/1970 | United Kingdom | 52/728 |
| 1325362 | 8/1973 | United Kingdom | 52/725 |

*Primary Examiner*—Richard E. Chilcot, Jr.
*Assistant Examiner*—Deborah McGann Ripley
*Attorney, Agent, or Firm*—Freilich Hornbaker Rosen

[57] ABSTRACT

A system is provided for use with structural steel members' lying in a corrosive atmospheric environment such as marine, wherein the system protects the members against corrosion. An elongated rigid envelope (20,22) that is gas tight surrounds the structural members (12,14) and extends along their lengths. A source (27) of pressured inert gas such as nitrogen is coupled through a regulator (25) to the inside of the envelope and maintains a pressure therein slightly greater than atmospheric. For wide flange members, the envelope's cross-section is preferably rectangular. Semi-globular protrusions (71,73,74,76), and (81,84,85,88) at the inside corners of the envelope and additional semi-globular protrusions (82,83,86,87) keep each side of the envelope moldings slightly spaced from the flanges of the members. The large space (26) provides a reservoir for inert gas, while providing minimum surface area of the envelope through which inert gas can be lost.

8 Claims, 1 Drawing Sheet

STRUCTURAL STEEL CORROSION PROTECTION BY INERT GAS

BACKGROUND OF THE INVENTION

Structural steel members sustaining a load, such as in bridges or in other applications, which are exposed to high humidity, rain, or salt water, require protection from corrosion. One approach to such protection is to coat the structural steel members with protective material. However, over a period of time the protective coating develops cracks that allow water to seep in, resulting in corrosion that, at the beginning, is hidden from view. A system for protection such structural steel members, which avoids concealed corrosion, would be of considerable value.

SUMMARY OF THE INVENTION

In accordance with the embodiments of the present invention, a system is provided for protecting structural steel members from corrosion and avoiding the undetectable beginning of the corrosive process. The system includes a rigid envelope disposed around a structural steel member, the envelope being gas tight and lying in the atmosphere. Pressured inert gas such as nitrogen lies inside the envelope at a pressure slightly greater than that of the atmospheric air around the envelope. Any cracks in the envelope that develop with age do not allow entrance of water, but allow only a slow exodus of inert gas from the envelope. Personnel maintaining the structure are informed as to the size of eventual cracks by noting the unexpected lowering of the pressure of inert gas in the envelope. The effects of the cracks can be countered either by refilling the envelope with inert gas more promptly, or by repairing the cracks in the envelope.

For a wide flange structural member, the surrounding envelope's cross-section is preferably of rectangular shape, with a pair of first sides lying close to the opposite flanges of the member, and with a pair of second sides lying far from either side of the web of the member. This arrangement results in a large volume to hold the inert gas, while resulting in a minimal area of the envelope which may develop cracks. The inside corners of the of the envelope, as well as other pertinent locations, are provided with semi-globular protrusions to keep the pair of first sides apart from either flange of the member; this is to assure that the entire surface of the structural steel member is exposed to inert gas.

The novel features of the invention are set forth with particularity in the appended claims. The invention is best understood from the following description when read in conjunction with the accompanying drawing.

DESCRIPTION OF THE EMBODIMENTS

Figure 1:
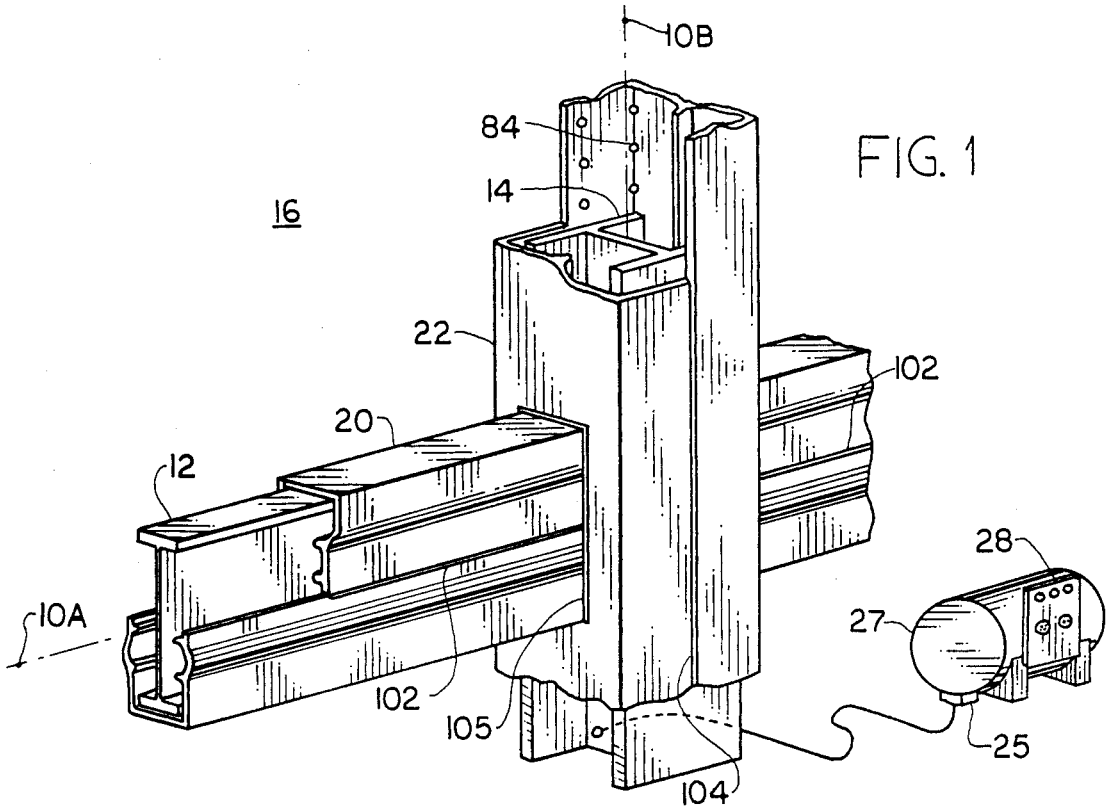
FIG. 1 is an isometric view of a structure with steel structural members surrounded by an envelope in accordance with the present invention.

FIG. 1 illustrates a portion of a structure which includes steel members such as a narrow flange member 12 used as a beam jointed to a wide flange member 14 used as a column. The structure lies in an environment

16 of the atmosphere, the particular environment being of high humidity including water from rain and/or ocean spray which tend to corrode structural steel. A sleeve-like rigid envelope 20,22 extends along the length of axes **10*a*,10*b* of steel structural members 12,14 respectively. The envelope is gas tight. A source 27 of pressured inert gas such as nitrogen is coupled through a regulator 25 to the inside of the envelope to maintain a pressure at the inside above the pressure on the outside. In the example, the source includes a tank of dry nitrogen at high pressure, such as recommended by industrial suppliers of compressed gases, and a regulator which reduces pressure in the source to the pressure in the envelope. Since the atmospheric pressure rises and falls, a regulator has an ultimate function of maintaining envelope pressure averaging 0.4 psi above atmospheric, or as arrived from testing an envelope of a given type and material. A control panel 28 informs maintenance personnel as to the inert gas pressure status in the envelope, as well as depletion of the same in the source 27**.

Figure 2:
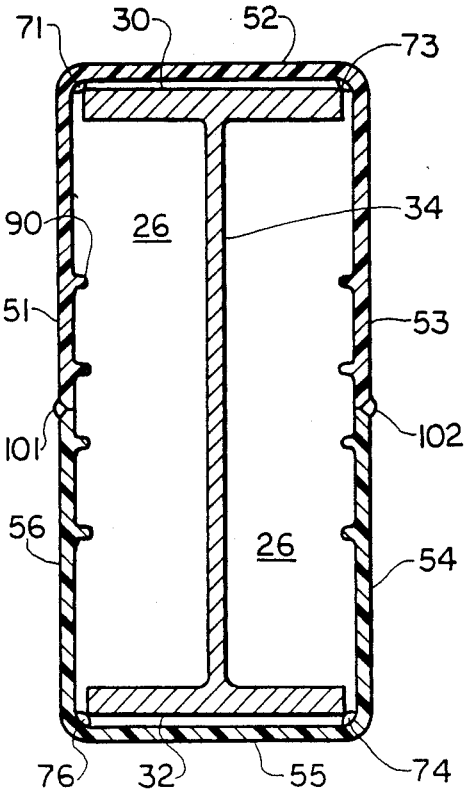
FIG. 2 is a cross-sectional view of the beam portion of the structure of FIG. 1.

FIG. 2 illustrates details of the envelope 20 that surrounds the structural steel member 12. The structural steel member has two opposite flanges 30,32 and a web 34 connecting them. The envelope is of practically rectangular cross-sectional shape at its inside and its outside. The envelope is composed of two separate molded parts that are joined. The top envelope part with sides 51,52,53 lies, with its side 52 adjacent and parallel to the outside surface of flange 30, and with its sides 51,53 away from and parallel to the web 34. The bottom envelope part with its sides 56,55,54, lies with its side 55 adjacent and parallel to the outside surface of the flange 32 and with its sides 56,54 away from and parallel to the web 34. The envelope includes semi-globular protrusions 71,73,74,76 located at the inside corners of the envelope, with the protrusions being spaced along the length of the envelope as depicted in FIG. 1 (the inside corner semi-globular protrusions shown spaced along the axis **10*b* being similarly spaced along the axis 10*a*). These protrusions serve the purpose of maintaining adequate clearance between the structural steel member and its envelope. The envelope has inside ribs 90** strategically located to prevent surface warping of the envelope's walls, as well as to compensate for transportion and installation perils to the envelope parts.

The top and bottom molds envelope parts are placed around the structural steel member until the edges of the sides 51,53 of one part touch the corresponding edges of the sides 56,54 of the other part. While the envelope parts are held in place, closure strips 101,102 are applied to seal the parts vapor-tight and to assure good envelope strength closure of the beginning and the end of the envelope along its structural steel members is accomplished by the envelope being affixed through a gasket to a steel plate.

Figure 3:
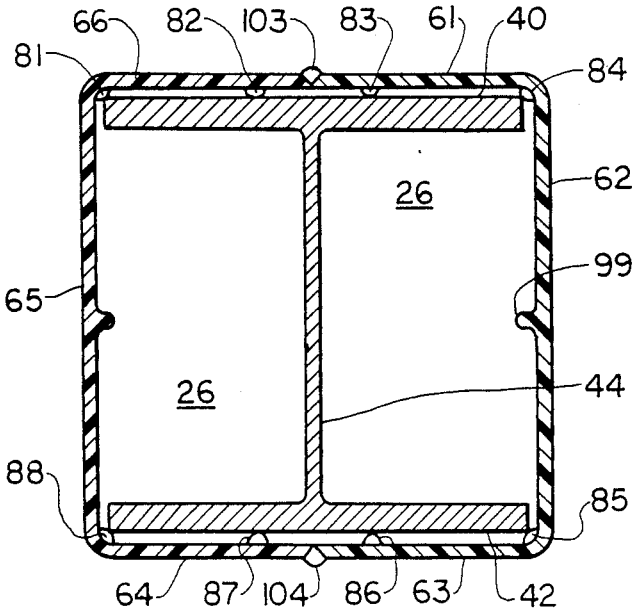
FIG. 3 is a cross-sectional view of the structure's column portion of the structure of FIG. 1.

FIG. 3 illustrates details of the envelope 22 that surrounds the structural steel member 14. The structural steel member has two opposite flanges 40,42 and a web 44 connecting them. The envelope is of practically rectangular cross-sectional shape at its inside and its outside. The envelope is composed of two separate envelope parts that are joined together. The left part with its sides 66,65,64, lies with its side 65 away from and parallel to the web 44, and with sides 66,64 adjacent and parallel to the outside surface of the flanges 40,42 respectively. The right side envelopes part with its sides 61,62,63, lies with its side 62 away from and parallel to the web 44, and with sides 61,63 adjacent and parallel to the outside surfaces of the flanges 40,42 respectively. The envelope includes the semi-globular protrusions 81,84,85,88 located at the inside corners of the envelope, and additional semi-globular protrusions 82,83,86,87 being all spaced along the length of the envelope as depicted in FIG. 1. These protrusions serve the purpose of maintaining adequate clearance between the structural steel member and its envelope. The envelope has inside ribs 99 strategically located to prevent surface warping of the envelope's walls, as well as to compensate for transportation and installation perils to the envelope parts.

The left and right envelope parts in FIG. 3 are placed around the structural steel member until the edges of the sides 66,64 of one part touch the corresponding edges of the sides 61,63 of the other part. While the envelope parts are held in place, closure strips 103,104 are applied to seal the molds vapor-tight and to assure good envelope strength. The envelopes around the members 12 and 22 (FIG. 1) are joined and sealed together vaportight with a closure strip 105 which is of such a strength and elastic properties as not to fail the rotation of the joint of said structural steel members. The beginning and the end closures of the envelope along its structural steel members are accomplished by the envelope being affixed through a gasket to a steel plate.

The invention provides an apparatus for protecting structural steel members from corrosion. The apparatus includes a rigid envelope that surrounds a structural steel member and an inert gas that is contained by said envelope at a pressure slightly higher than the immediate atmosphere. The envelope components are formed of a material such as fiberglas reinforced resins or other composite materials that are resistant to aging from sunlight. The envelope, after its assembly, is like a hermetic coverall consisting of a few, or many, separate sleeves and the whole thing being inflated by inert gas from a central source. There may be more than one central source of pressured gas if there are many envelopes installed next to each other on a given structure, or there may be one central source of pressured gas supplying all envelopes.

The shape of the envelope cross-section, whether square, rectangular, circular, triangular, pentagonal or otherwise, is dictated by the architectural considerations. The location of the longitudinal joints of the envelopes is dictated by architectural preference and the envelopes' manufacturer convenience.

The structural steel members made of built-up section, such as chords of large trusses or girders, when enclosed by a rigid envelope to contain inert gas, should have the inside of the envelope provided with extra semi-globular protrusions along their lengths; this is to prevent walls of the envelope, where there are no ribs, from inward warping due to envelope thermal expansion. All tubular milled members of structural steel, such as rectangular, square or round when enclosed by a rigid envelope containing inert gas, should be perforated for even gas distribution.

Although particular embodiments of the invention have been illustrated and described herein, it is recognized that modifications and variations may readily occur to those skilled in the art, consequently it is intended to cover such modifications, variations and equivalents.

I claim:

1. Apparatus, for use in an protecting an elongated structural steel member from corrosion, comprising:

an elongated rigid envelope extending along a length direction of said structural member and surrounding said structural member, said envelope being gas tight; and a quantity of inert gas inside said envelope, said inert gas being at a pressure greater than that of the environment around said envelope.

2. The apparatus described in claim 1 wherein:

said structural member has a plurality of sides and a plurality of corners, and said envelope has a plurality of sides and a plurality of corners with internal protrusions that bear against a plurality of said member corners.

3. The apparatus described in claim 1 wherein:

said structural member comprises a beam with opposite flanges and a web connecting said flanges;

said envelope is of largely rectangular cross section, with a first pair of opposite sides lying facewise close to said structural member flanges, creating a space between said first sides and corresponding said flanges, and with a second pair of opposite sides lying on opposite sides of said web, with at least one of said second sides spaced from said web by a distance which is a plurality of times greater than said space between either of said first envelope sides from a corresponding one of said flanges.

4. The apparatus described in claim 1 wherein:

said structural member is an I-beam with opposite flanges and a web connecting the middle of said flanges;

said envelope is of largely rectangular cross section, with a first pair of sides lying adjacent to said flanges, and a second pair of sides spaced far from opposite sides of said web.

5. The apparatus described in claim 1 wherein:

said envelope includes first and second envelope parts that fit around said steel member and that have a pair of adjacent edges, and a pair of sealing strips joining said adjacent edges in a substantially gas-tight fit.

6. The apparatus described in claim 1 including:

a second elongated structural steel member extending perpendicular to said first named structural member and securely joined thereto in a load carrying joint;

a second elongated rigid envelope extending along the length direction of said second structural member and surrounding it, said second envelope being gas tight; and said first and second envelopes having an inside, being coupled so said inert gas can flow between them.

7. The apparatus described in claim 1 including:

a source of pressured inert gas at a pressure that is a plurality of times greater than atmospheric; and a pressure reduction regulator coupling said source to the inside of said envelope.

8. A structure comprising:

an elongated structural steel member;

a substantially rigid envelope surrounding said structural member and being substantially gas tight, said envelope being surrounded by an atmosphere;

a source of pressured inert gas coupled to said envelope, and maintaining a pressure therein at least as great as that of the surrounding atmosphere.

* * * * *